US005469960A

United States Patent [19]

Yuill

[11] Patent Number: 5,469,960

[45] Date of Patent: Nov. 28, 1995

[54] GOLF BAG

[75] Inventor: Robert M. Yuill, Aberdeen, Scotland

[73] Assignee: James Richard Ingleby, United Kingdom; a part interest

[21] Appl. No.: 277,940

[22] Filed: Jul. 20, 1994

Related U.S. Application Data

[63] Continuation of Ser. No. 39,024, filed as PCT/GB91/01635, Sep. 24, 1991, published as WO92/05842, Apr. 16, 1992, abandoned.

[30] Foreign Application Priority Data

Sep. 28, 1990 [GB] United Kingdom ..... 9021285

[51] Int. Cl.[6] ..... A63B 55/00; A63B 55/06

[52] U.S. Cl. ..... 206/315.3; 206/315.6; 206/315.7; 206/315.8; 248/96

[58] Field of Search ..... 206/315.3, 315.4, 206/315.5, 315.6, 315.7, 315.8; 248/96; 211/70.2; 280/DIG. 6

[56] References Cited

U.S. PATENT DOCUMENTS

| | | | |
|---|---|---|---|
| 646,869 | 4/1900 | Perkes | 280/DIG. 6 X |
| 1,325,692 | 12/1919 | Cross | 206/315.4 |
| 1,442,906 | 1/1923 | Rawlings et al. | 206/315.6 X |
| 1,570,500 | 1/1926 | Kennedy | 206/315.6 |
| 1,591,914 | 7/1926 | Farish | 206/315.7 X |
| 1,939,488 | 12/1933 | Dent et al. | 206/315.4 X |
| 2,047,079 | 7/1936 | MacMurray | 206/315.5 X |
| 2,070,254 | 2/1937 | Burgner | 210/70.2 |
| 2,186,491 | 1/1940 | Meyer | 206/315.7 |
| 2,282,842 | 5/1942 | Abell | 206/315.7 X |
| 2,283,412 | 5/1942 | Bright | 206/315.5 |
| 2,422,315 | 6/1947 | Robinson | 248/96 X |
| 2,502,627 | 4/1950 | Martin | 206/315.6 |
| 2,837,346 | 6/1958 | Chambless | 206/315.4 X |
| 2,857,168 | 10/1958 | Neaverson et al. | 280/DIG. 6 X |
| 3,232,503 | 2/1966 | Thonen | 211/70.2 X |
| 3,779,297 | 12/1973 | Stammer | 206/315.6 |
| 3,967,667 | 7/1976 | Robinson | 206/315.6 |
| 4,227,559 | 10/1980 | Stroman | 206/315.6 |
| 4,334,564 | 6/1982 | Clayton | 206/315.6 |
| 4,664,382 | 5/1987 | Palmer et al. | 206/315.6 X |
| 4,674,747 | 6/1987 | Mazzocco et al. | 206/315.6 X |
| 5,042,654 | 8/1991 | Jones | 206/315.3 |

FOREIGN PATENT DOCUMENTS

| | | | |
|---|---|---|---|
| 9204 | 7/1933 | Australia | 206/315.4 |
| 291934 | 6/1928 | United Kingdom . | |
| 733631 | 7/1955 | United Kingdom | 280/DIG. 6 |

*Primary Examiner*—Sue A. Weaver
*Attorney, Agent, or Firm*—Pennie & Edmonds

[57] ABSTRACT

A golf bag for golf clubs is divided longitudinally up the front and the edge stiffened by edge members (18, 20). Golf club retaining tubes (6) or flaps (76) are arranged serially around the periphery of the sidewall of the bag. A lever (26, 100) operates to open the front of the bag and present the club heads in an organised serial manner, which assists finding the selected club. The handle also extends a pair of legs (40, 42) which form a stand for the bag.

15 Claims, 9 Drawing Sheets

GOLF BAG

This is a continuation, of application Ser. No. 08/039,024, filed a PCT/GB91/01635, Sep. 24, 1991, published as WO92/05842, Apr. 16, 1992, now abandoned.

BACKGROUND OF THE INVENTION

The present invention relates to a golf bag for carrying golf clubs.

Conventional golf bags are usually tubular in shape and are generally constructed to carry up to 14 clubs. The clubs are turned upside down and inserted into the bag handle downwards so that the head of the club (which strikes the ball) is uppermost. The heads of the clubs are usually numbered to assist selection of the correct club. Conventionally, the inside of the bag is sub-divided into compartments by parallel webs, such that the clubs are aligned in rows. However, it is found that the club heads do not all fall naturally into a parallel alignment, which makes reading the numbers on the club heads somewhat difficult:. Moreover, the clubs are not usually held in individual specific locations so that it is not easy to arrange the clubs in a numbered sequence and to keep the clubs in that sequence as the bag is carried around. It is known to provide internal plastic tubes to define individual club locations, but nevertheless the clubs are still usually arranged in rows.

Golf bags are also known in which the clubs are arranged in a single line around the periphery of the bag. This facilitates location of a desired club from within the sequence, but such bags make poor use of available space and tend to be wider than normal.

British patent specification GB2178966 discloses a golf bag having a series of tubes intended to carry clubs having telescopic shafts, which zips up the rear from the base to allow access to the clubs.

British patent specification GB291934 describes a golf bag which is also split up the rear to allow contraction and expansion of the mouth of the bag. A V-shaped piece is fitted into the split, and may accommodate some of the smaller clubs.

U.S. Pat. Nos. 4,227,559 and 4,334,564 show golf bags composed of a single line of tubes for receiving the clubs. For storage the bags may be opened out into a flat configuration.

It is an object of the present invention to mitigate these problems and to provide a golf bag in which the selection of golf clubs is facilitated.

SUMMARY OF THE INVENTION

The present invention provides a golf bag for carrying golf clubs which comprises a generally tubular bag member having a base and a side wall depending therefrom, the side wall being divided longitudinally along a front thereof, so as to provide a pair of opposed sidewall edges, edge members being provided along each sidewall edge, each edge member being pivotally mounted at its lower end, opening means operatively connected to the sidewall edge members for enabling movement apart of the edge members, such that the bag member is opened out at its upper end in a fan-like manner; and a series of golf club retaining locations arranged around the inner circumference of the sidewall, such that opening of the sidewall by operation of the opening means presents the clubs in a fan-like serial manner.

In the present specification, the front of the bag will be understood to be that part of the bag normally provided with a strap or handle for carrying. As in conventional bags, two pockets are normally provided, a smaller pocket at the lower end of the front of the bag for holding golf balls and other small items, and a larger pocket extending about two thirds of the way up the rear of the bag for holding larger items such as articles of clothing.

The fan-like opening of the bag presents the clubs in an easy-to-see organised serial arrangement and helps the desired club to be located with the minimum of searching. The club heads tend to fall into a generally parallel arrangement, each head approximately radically of the sidewall circumference.

The longitudinal division of the bag generally extends to substantially the base thereof, so as to maximise the degree of opening. In fact, it is preferred that the sides of the longitudinal division converge so as to come closer together at the top than at the base when the bag is closed. Usually, the lower part of the longitudinal division will be partially covered by the front pocket and possibly a web of loose material extending over the bottom third or half of the longitudinal division.

Whilst a sidewall is referred to, it should be understood that this can be replaced by equivalent frame structure. The bag will however generally include a suitable weatherproof outer covering to protect the clubs.

The golf club retaining locations arranged around the inner circumference of the bag member are preferably a series of lightweight tubes, or hook-section flaps; or a series of pockets sewn into the bag member.

In order to provide structural integrity, it is preferred that the central golf club retaining locations be rigidly held in a generally semi-circular arrangement by suitable frame members, whilst the retaining location on either side thereof are free to fan out when the bag is opened.

Means are preferably provided for holding the bag member in its opened configuration. This may be in the form of an elbow joint having either a free end attached to a respective side of the longitudinal division and which is straightened in order to open the bag. The elbow joint may form part of an over-centre mechanism. The elbow joint may be moved downwardly in order to straighten it and open the bag, its downward travel being limited by a longitudinal pillar forming part of the frame of the bag and disposed at the front thereof. In this way, one end of the carrying strap for the golf bag may be attached (directly or indirectly) to the elbow joint such that when the bag is carried, the weight of the bag causes the joint to close, thereby closing the bag member.

Alternatively, the bag may be provided with means which bias it into the open configuration, such as a strip of spring material (e.g. metal or plastics) secured around the upper end. Means are then provided to draw together the sidewalls in the closed configuration, for example draw strings, against the biasing.

Preferably locking means are provided for locking the bag in the closed position, and possibly also the open position.

In a particularly preferred embodiment of the invention, a pair of legs are provided at the rear of the bag for supporting the bag in a generally upright position when the bag is set down on the ground. It is particularly convenient if the mechanism for opening the bag member is connected to means for throwing out the legs from a retracted position alongside the bag member. Typically, the legs are thrown out at 30°–35° to the line of the tubular bag member. Preferably, the legs are thrown out in a generally radial direction so as to form a tripod-like configuration.

If desired, closure means, such as a clip or strap may be provided at an upper end of the longitudinal division for securing the bag in its closed position when the bag is not being used.

BRIEF DESCRIPTION OF THE DRAWINGS

Embodiments of the present invention will now be described by way of example only in conjunction with the attached drawings wherein.

DETAILED DESCRIPTION OF PREFERRED EMBODIMENTS

Figure 1:
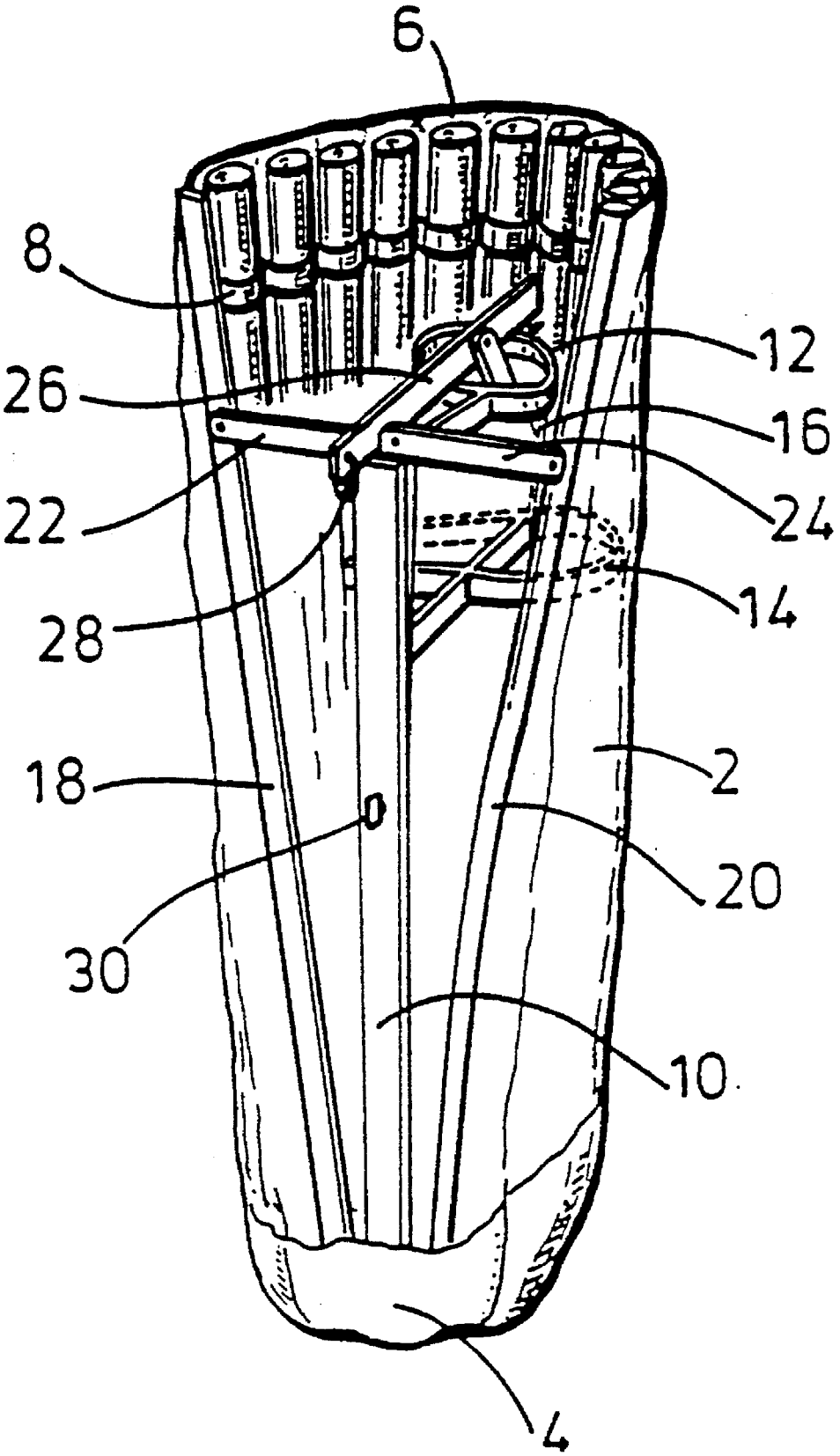
FIG. 1 is a perspective sketch of a golf bag according to a first embodiment of the invention in its open state.
Figure 2:
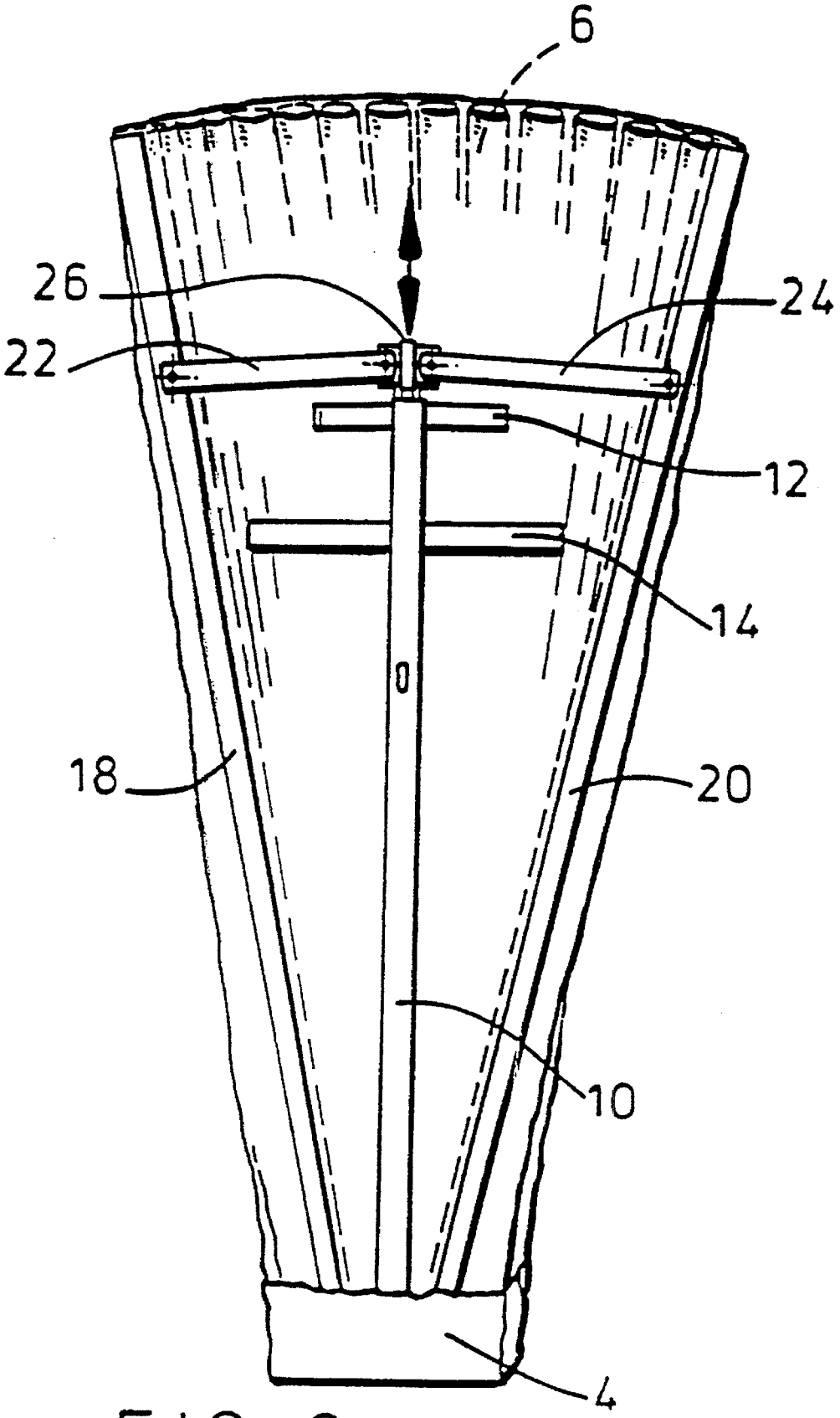
FIG. 2 is a front elevation thereof.

As shown in FIGS. 1 and 2, the golf bag comprises a generally tubular bag member 2 having a base 4. A plurality (usually 14) of plastic tubes 6 are arranged around the periphery of the bag member and secured in place by means of a strap 8 stitched between each tube to the bag member 2. In use, golf clubs (not shown) are inserted handle-first into the respective tubes.

The golf bag is strengthened by means of a frame of lightweight construction such as aluminium alloy, and comprises a pillar 10 at a front thereof and depending rearwardly therefrom are an upper ring member 12 and a lower ring member 14. The lower ring member 14 has a generally semi-circular rear portion which passes behind the centremost six plastic tubes in order to provide support therefor. The upper ring member 12 also has a semi-circular rear portion which lies in front of the centremost six plastic tubes. The upper and lower ring members 12, 14 are interconnected at the rear of the bag by an upright frame member 16.

The front of the bag member 2 is divided longitudinally and the edges of the longitudinal division are strengthened by means of edge members 18,20 formed of angle metal. The bottom of each member 18,20 is hingedly attached to the base of the bag member. In the closed state of the bag, the members 18,20 are closer together at the top than at the bottom i.e. they diverge downwardly. This limits the angle at which the clubs are inclined when the golf bag is opened and makes for a stabler structure both in the open and closed state. For clarity, the front pocket is omitted from FIGS. 1 and 2.

The bag may be opened by means of an elbow mechanism comprising a pair of links 22,24 pivotally attached at their outer ends to respective edge members 18,20 and pivotally attached in the centre to a lever 26, which is in turn pivotted at its rear end to the upright frame member 16. When lever 26 is raised, the elbow joint collapses and the bag closes until the upper ends of edge members 18,20 abut one another. A ring 28 is provided at the front of the lever 26, and an eye 30 is attached to the pillar 10, to allow a shoulder strap to be fitted between them.

Figure 3:
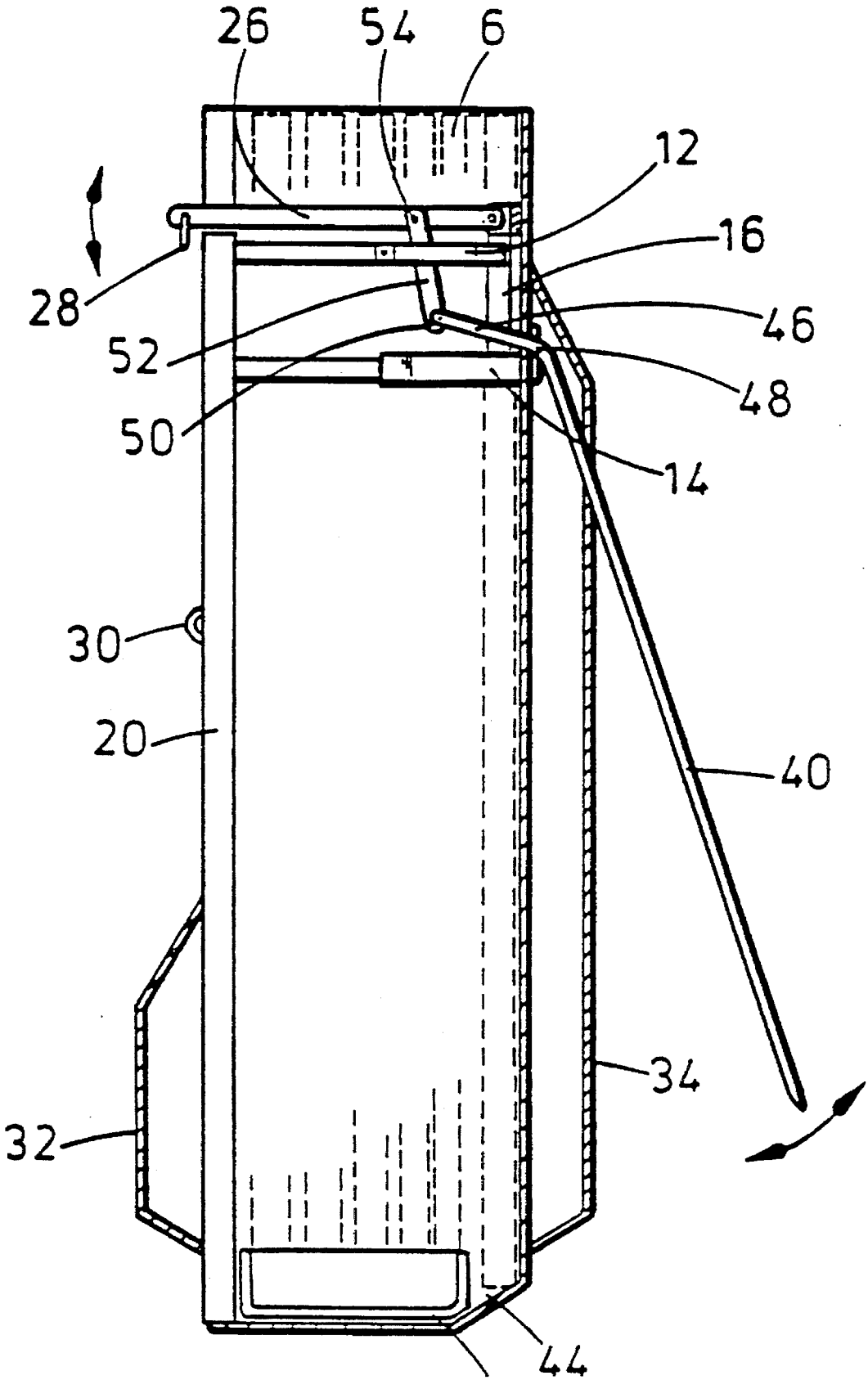
FIG. 3 is a sectional elevation along 3—3' of FIG. 5.

The arrangement is shown in more detail in FIG. 3, which also shows the front pocket 32 and rear pocket 34. A bowl-shaped base member 36 is provided in the base of the bag to hold in place the lower ends of the tubes 6.

Figure 4:
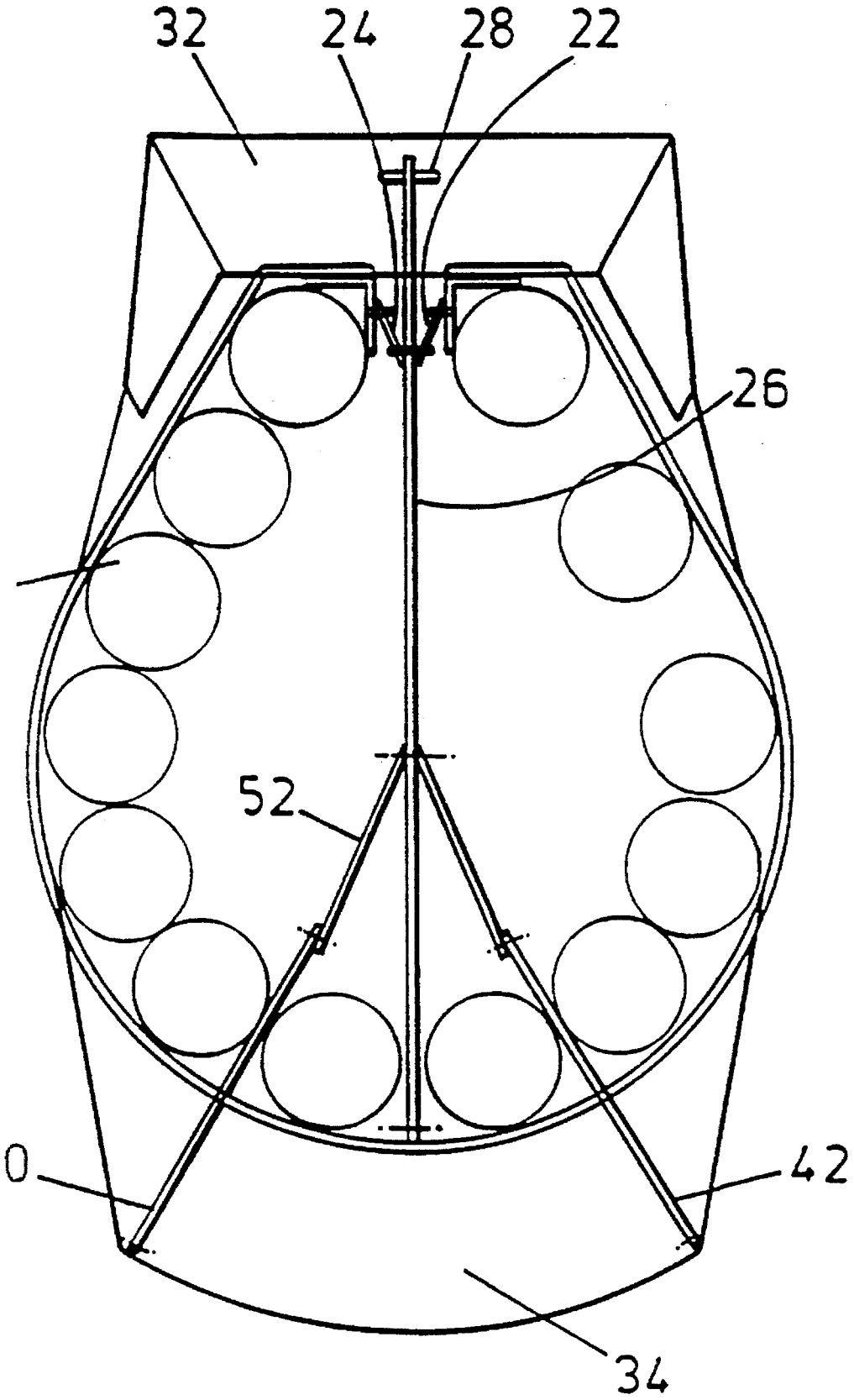
FIG. 4 is a plan view of the golf bag in its closed state.
Figure 5:
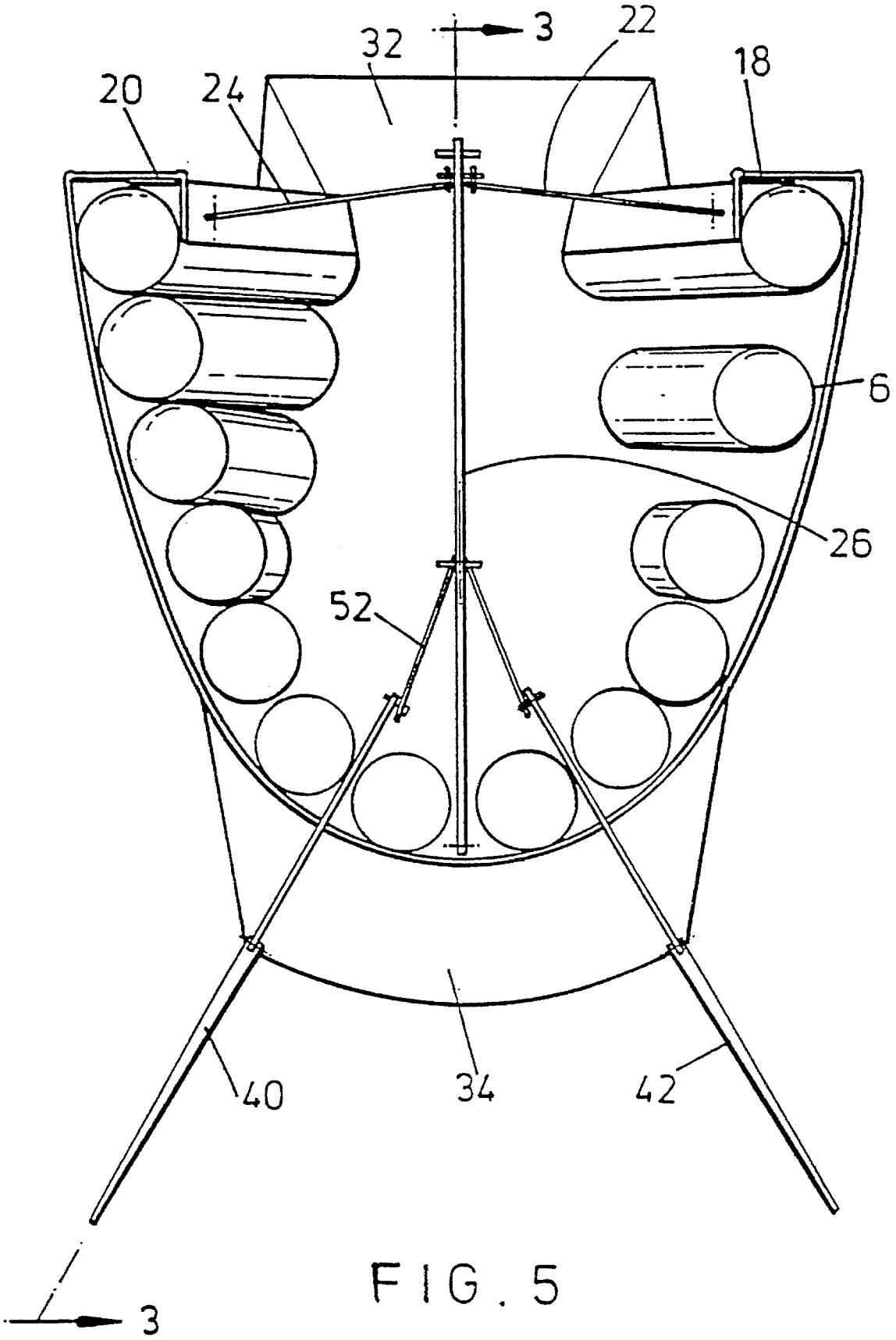
FIG. 5 is a plan view of the bag in its open state.

The golf bag also includes a pair of legs 40,42 which in the normal closed position of the bag lie to either side of the rear pocket 34 (see FIG. 4), but which are thrown outwardly to the position shown in FIGS. 3 and 5 by the action of moving the lever 26 downwardly to open the bag. This allows the bag to rest on its chamfered base portion 44 in its open position at an angle which is both stable and suitable for presenting the clubs in an orderly manner to the player. Thus, the upper end of each leg 40,42 includes a cranked portion 46. Each leg is pivotted at the bend of the crank 48 to the rear of the lower frame ring 14. The upper end of each leg is pivotted at 50 to a linkage 52 which is in turn pivotally connected at 54 to the lever 26. In this way, downward movement of the lever 26 causes pivotal movement of the cranked leg about pivot 48 to throw the legs outwardly to an angle of about 30°–35° relative to the line of the bag.

The golf bag may be used in the following manner. When the golf bag is in the open position as shown in FIGS. 1 to 3 and 5, the front of the bag is held open by links 22,24, and lever 26 resting on the top of pillar 10. In this configuration, the six central plastic tubes are rigidly retained in place by rings 12,14, whilst the outer tubes at either side thereof are fanned outwardly so that the golf clubs contained in the tubes are presented in an orderly serial manner to the player. Usually, the woods are placed on the lefthand side (looking at FIG. 1) whilst the irons number from the highest number in the central area to the lowest number at the righthand end. The bag is tilted backwardly and rests on legs 40,42. At this angle, the club heads are conveniently viewed and tend to adopt positions roughly parallel to each other in a generally radial direction. This greatly facilitates reading the numbers on the bottom of the club heads, so assisting location and selection of the chosen club. When the shot has been played, the club is replaced in the bag and the bag is closed by lifting lever 26 or by using a strap fixed between ring 28 and eye 30. Either way, the effect of the weight of clubs in the bag is to raise lever 26. Raising lever 26 has two effects. Firstly, the elbow joint comprised of links 22,24 is bent, thereby bringing together the upper ends of edge members 18,20 and closing the front of the bag to a configuration suitable for carrying. Secondly, raising the lever 26 pulls linkage 52, thereby operating crank 46 and drawing legs 40,42 inwardly to lie against the side of the bag member on either side of the rear pocket 34. Thus, in a single movement of raising lever 26 by picking up the bag, the bag is both closed and the legs retracted. The bag can then be conveniently carried to a new location where it can be set down by a reverse of the above procedure for playing a new shot. The bag is set down on the ground in an upright position. Lever 26 is pushed downwardly, thereby opening the bag and throwing out the legs. Finally, the bag is tilted backwards so as to rest on the legs, when a new club may be selected.

A second embodiment is shown in FIGS. 6–11 which is generally similar to the first embodiment, except that the mechanism for opening and closing the bag (and extending the legs) is different. Generally similar items use the same reference numbers.

In the second embodiment, the plastic tubes 76 for holding the golf clubs are hook-shaped in cross-section, each comprising a flange portion 77 sewn or adhered to the sidewall (or integrally moulded therewith) and a free generally semi-circular portion 78. This arrangement minimises weight and makes good use of available space, allows the clubs to dry, and also facilitates relative movement of the tubes when the sidewall is opened out. If necessary a loose strap 8 (not shown) may also be provided to support the tubes 76.

Figure 6:
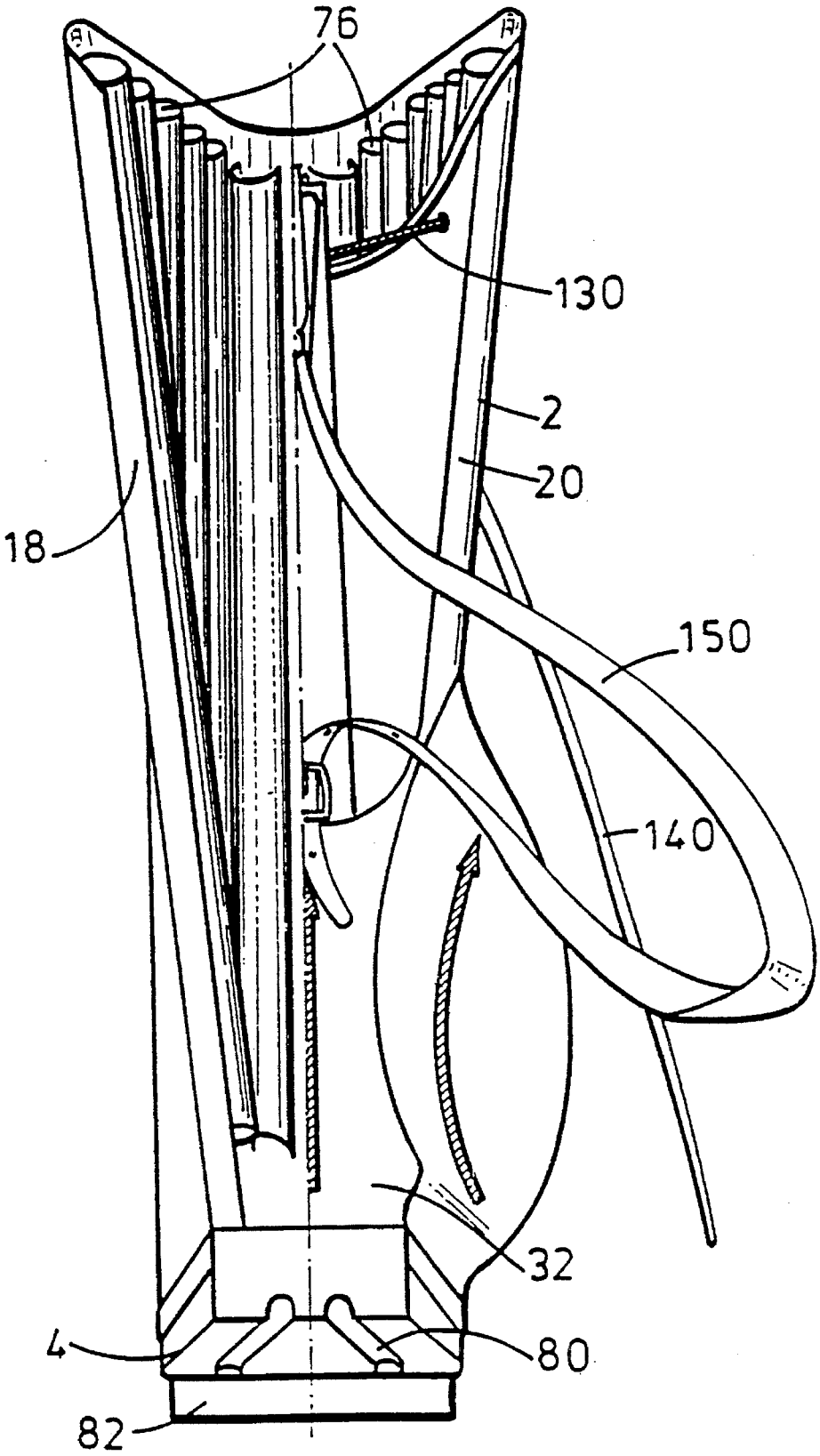
FIG. 6 is a part-cutaway front elevation (from below) of a second embodiment of the golf bag.

As particularly shown in FIG. 6, the base 4 is injection moulded or vacuum-formed to include a peripheral U-shaped ridge 80 which adds strength and also serves to locate the ends of the golf club handles. A bar 82 is also provided in the base, which assists pivotting of the base to the inclined position (FIG. 8) where it forms a tripod with extended legs 40, 42.

Figure 7:
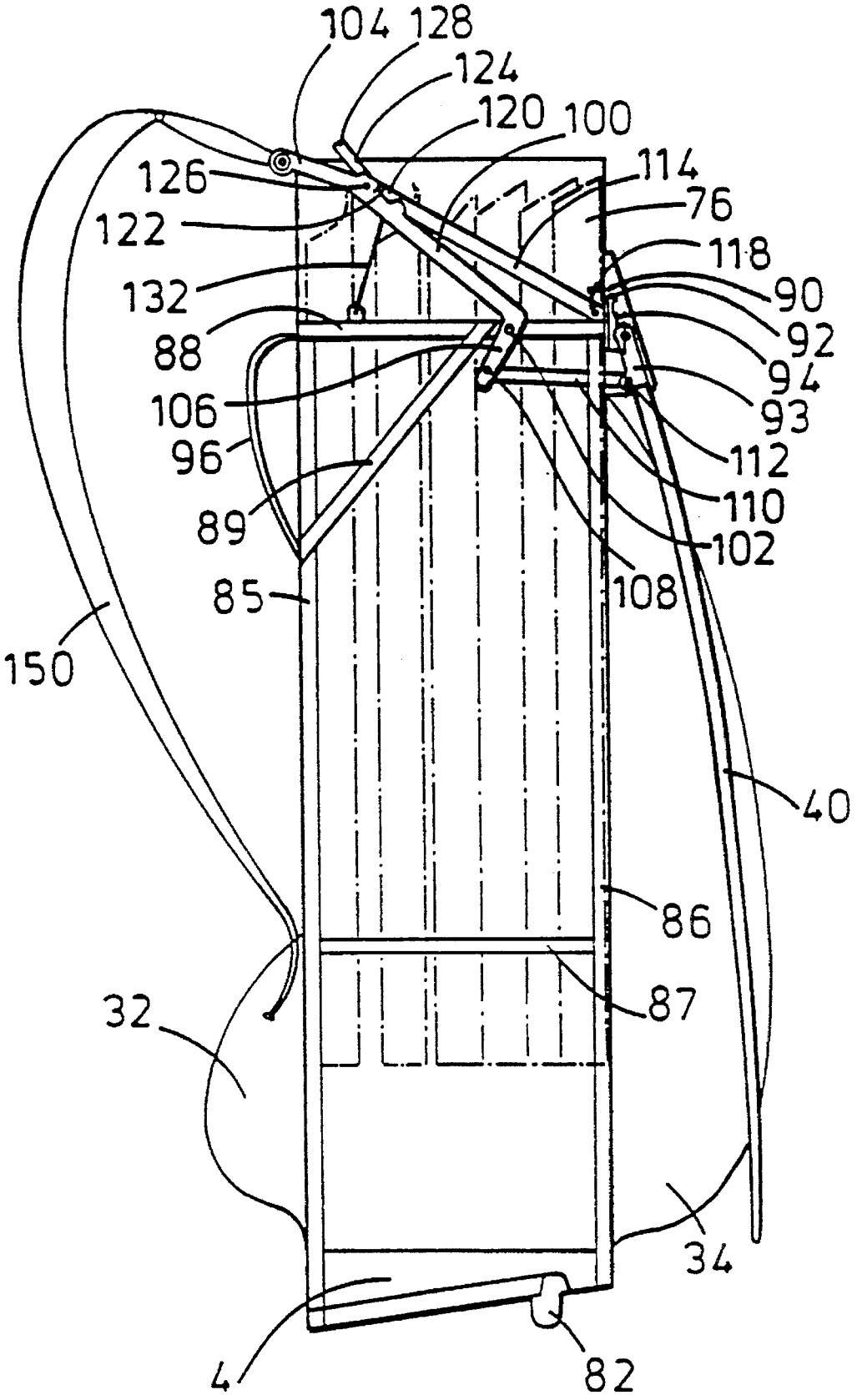
FIG. 7 is a side elevation with the sidewall material removed to show the closure mechanism (bag closed)
Figure 9:
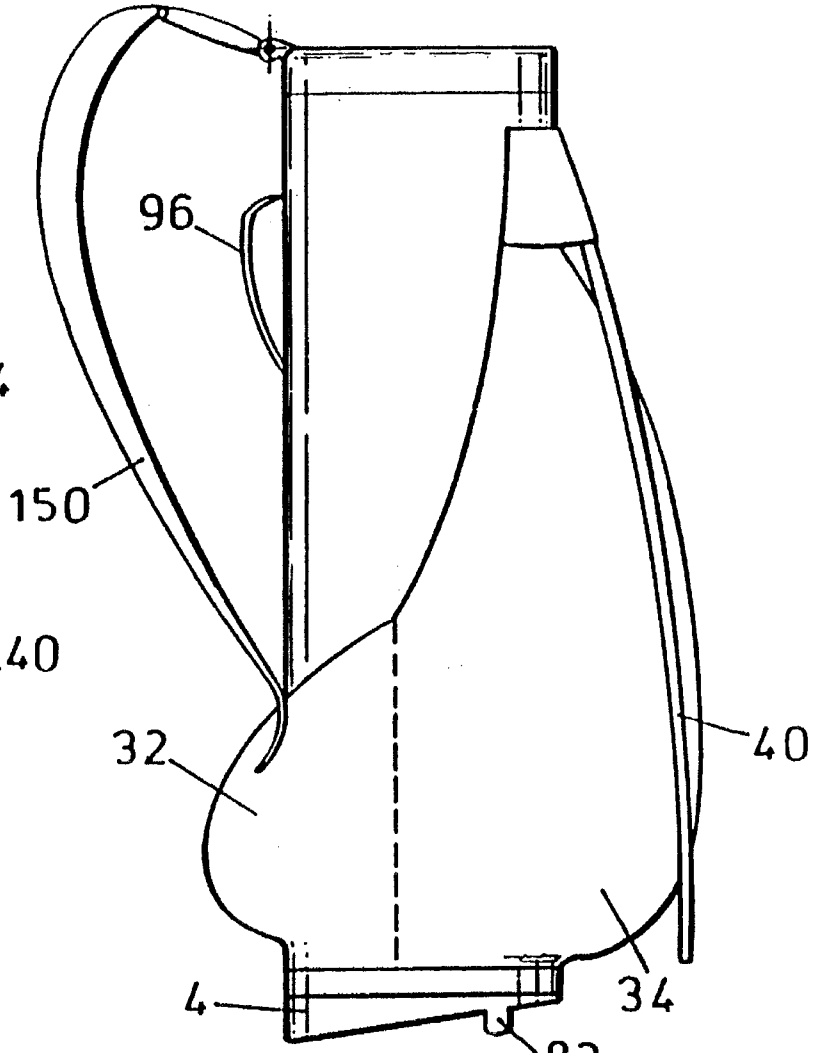
FIG. 9 is a side view of the bag.
Figure 8:
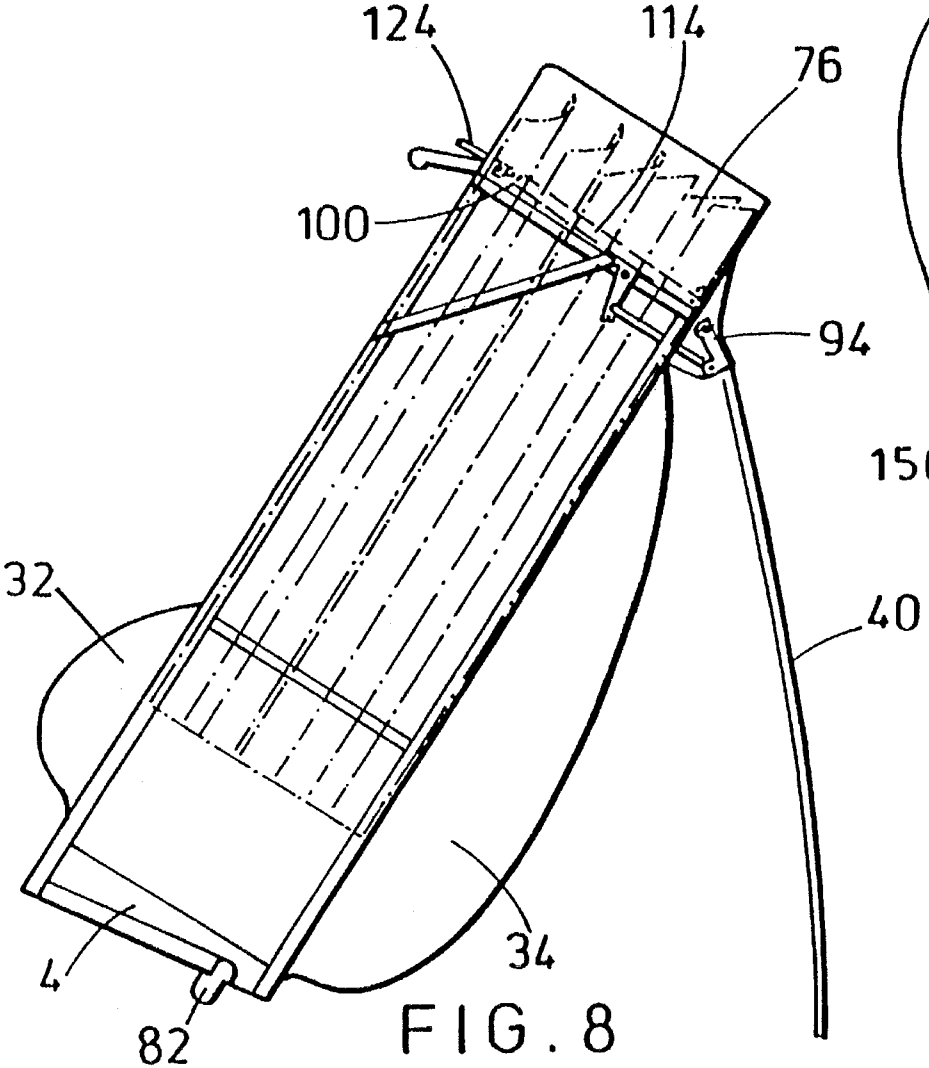
FIG. 8 is a side elevation (sidewall removed) showing the bag in its open position resting on its extended legs.
Figure 11:
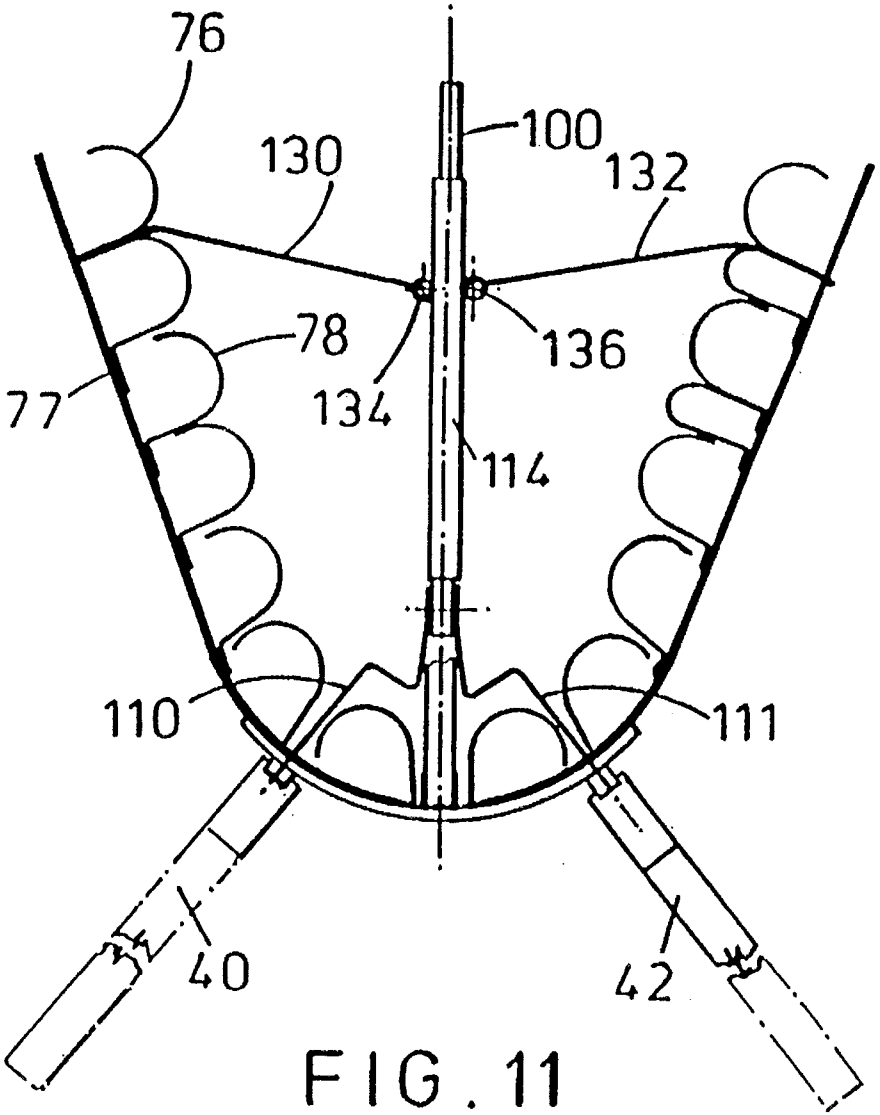
FIG. 11 is a plan view of the bag in its open position with legs extended.
Figure 10:
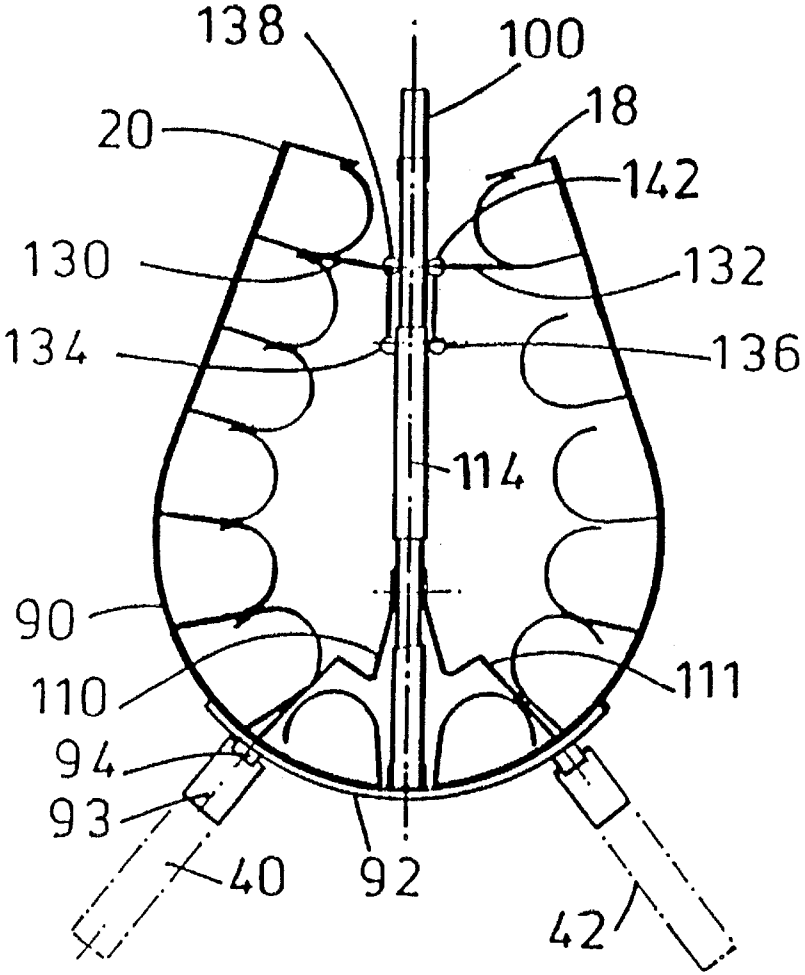
FIG. 10 is a plan view of the bag in its closed position.

As shown in FIG. 7, the bag includes an interior frame formed of front pillar 85 and rear pillar 86 which are attached to base 4 at their lower end, interconnected partway up by cross-member 87, and interconnected at the top by top member 88 and brace 89.

In order to bias the bag into the open configuration, a strip of spring steel 90 is attached to the top of the sidewall and secured to the upper end of rear pillar 86. A curved rigid plate 92 is also attached to the upper end of the rear pillar so as to hold rigidly the central clubs and also to mount the legs 40, 42. Each leg is removably received in a socket 93 on a hinge body 94 mounted on plate 92, which allows the legs to be clipped in or out for storage. A carrying handle 96 is attached to front pillar 85.

The bag may be closed against the bias of the spring steel by operating a lever 100 which is pivotally mounted at 102 to top member 88 and comprises a handle portion 104 and a crank portion 106. The free end of the crank portion is pivotted at 108 to S-shaped spring linkages 110, 111 each of which is in turn pivotally connected at its other end to a point 112 on the hinge socket 93 spaced away from the hinge itself. Thus downward movement of lever 100 acts to extend the legs 40, 42. The S-spring linkage acts to resiliently bias the legs into the extended position, and also allows for the non-alignment of the movement of the lever 100 and the hinges.

The lever 100 may be locked in the raised position (with the bag in the closed state) by means of arm 114 and catch 124. Arm 114 is pivotted at 118 to rear pillar 86, and at its free end has a tongue 120 which engages a notch 122 in the lever 100, thereby preventing movement of the lever. The catch 124 is pivotted at 126 to the lever and has a free end (not shown) which underlies the tongue 120 in its engaged position. Pushing down on the other end 128 of the catch disengages the arm when the bag is to be opened.

The free end of arm 114 is attached at 134, 136 to each edge member 18, 20 by a respective cord 130, 132. The cords also pass through respective eyes 138, 142 on either side of top member 88. Thus, on raising lever 100 to close the bag, arm 114 is thereby moved upwards drawing the cords with it, and so pulling together edge members 18, 20 to close the bag.

As shown in FIGS. 6 and 7, a carrying strap 150 is attached to the free end of lever 100. Thus, picking up the bag by the carrying strap automatically raises the lever, closes the bag and retracts the legs.

I claim:

1. A golf bag for carrying golf clubs which comprises a generally tubular bag member having a base and a side wall extending therefrom, the side wall being divided longitudinally along a front thereof, so as to provide a pair of opposed sidewall edges, a respective edge member being provided along each sidewall edge, each edge member being substantially rigid and having a respective upper end and lower end, each of said pair of edge members being mounted at its lower end to the base at respective first and second mounting points in a manner whereby the pair of edge members are pivotally mounted to allow pivotal movement relative to one another such as to open the sidewall of the bag member, the first and second mounting points being spaced apart from each other;

opening means operatively connected to the substantially rigid sidewall edge members for moving apart the upper ends of the edge members, such that the bag member is opened out at its upper end in a fan-like manner;

a series of individual golf club retaining means arranged in locations around the inner circumference of the sidewall, each said individual golf club retaining means being adapted to receive a single golf club, such that opening of the sidewall by operation of the opening means presents the clubs in a fan-like serial manner; and a pair of legs hingedly mounted to a rear portion of the sidewall of the generally tubular bag member; and means operatively connected to the opening means for throwing the legs outwardly from a retracted position alongside the bag member to an extended position wherein the legs form a tripod arrangement with the base of the bag, when the opening means are operated.

2. A golf bag according to claim 1 wherein the series of golf club retaining means comprises a central series of golf club retaining means which are rigidly held by said generally tubular bag member in a generally curved arrangement in some of said locations around the inner circumference of the sidewall, and comprises a first outer series and a second outer series of golf club retaining means arranged in locations around the inner circumference of the sidewall on either side of said central series of golf club retaining means and adjacent the respective rigid edge members, said first and second outer series of golf club retaining means being free to fan out when the bag is opened.

3. A golf bag according to claim 1 wherein the opening means is a lever having a free end and an end which is pivotally attached to a bag member; the free end being movable downwardly between said opposed edge members from an upper position wherein the bag is closed to a lower position wherein the bag is opened.

4. A golf bag according to claim 1, which further comprises locking means for locking the opening means in a position wherein the bag is open or closed.

5. A golf bag according to claim 1, wherein the opening means comprises spring means which resiliently biases the bag into the open position wherein the clubs are presented in a fan-like serial manner; and which further comprises closing means operating against the spring means to close the bag.

6. A golf bag for carrying golf clubs which comprises a generally tubular bag member having a base and a side wall extending therefrom, the side wall being divided longitudinally along a front thereof, so as to provide a pair of opposed sidewall edges, a respective edge member being provided along each sidewall edge, each edge member being substantially rigid and having a respective upper end and lower end, each of said pair of edge members being mounted at its lower end to the base at respective first and second mounting points in a manner whereby the pair of edge members are pivotally mounted to allow pivotal movement relative to one another such as to open the sidewall of the bag member, the first and second mounting points being spaced apart from each other;

opening means operatively connected to the substantially rigid sidewall edge members for moving apart the upper ends of the edge members, such that the bag member is opened out at its upper end in a fan-like manner; and a series of individual golf club retaining means arranged in locations around the inner circumference of the sidewall, each said individual golf club retaining means being adapted to receive a single golf club, such that opening of the sidewall by operation of the opening means presents the clubs in a fan-like serial manner, wherein the golf club retaining means are in the form of longitudinally extending flaps which are hook-shaped in cross-section, each flap comprising a curved free side portion for embracing a golf club handle and a flat portion attached to the sidewall.

7. A golf bag according to claim 6 wherein the series of golf club retaining means comprises a central series of golf club retaining means which are rigidly held by said generally tubular bag member in a generally curved arrangement in some of said locations around the inner circumference of the sidewall, and comprises a first outer series and a second outer series of golf club retaining means arranged in locations around the inner circumference of the sidewall on either side of said central series of golf club retaining means and adjacent the respective rigid edge members, said first and second outer series of golf club retaining means being free to fan out when the bag is opened.

8. A golf bag according to claim 6 wherein the opening means is a lever having a free end and an end which is pivotally attached to a bag member; the free end being movable downwardly between said opposed edge members from an upper position wherein the bag is closed to a lower position wherein the bag is opened.

9. A golf bag according to claim 6, which further comprises locking means for locking the opening means in a position wherein the bag is open or closed.

10. A golf bag according to claim 6, wherein the opening means comprises spring means which resiliently biases the bag into the open position wherein the clubs are presented in a fan-like serial manner; and which further comprises closing means operating against the spring means to close the bag.

11. A golf bag for carrying golf clubs which comprises a generally tubular bag member having a base and a side wall extending therefrom, the side wall being divided longitudinally along a front thereof, so as to provide a pair of opposed sidewall edges, a respective edge member being provided along each sidewall edge, each edge member being substantially rigid and having a respective upper end and lower end, each of said pair of edge members being mounted at its lower end to the base at respective first and second mounting points in a manner whereby the pair of edge members are pivotally mounted to allow pivotal movement relative to one another such as to open the sidewall of the bag member, the first and second mounting points being spaced apart from each other;

opening means operatively connected to the substantially rigid sidewall edge members for moving apart the upper ends of the edge members, such that the bag member is opened out at its upper end in a fan-like manner, and a carrying strap attached at one end to said opening means, whereby picking up the bag by the strap operates the opening means to close the bag; and a series of individual golf club retaining means arranged in locations around the inner circumference of the sidewall, each said individual golf club retaining means being adapted to receive a single golf club, such that opening of the sidewall by operation of the opening means presents the clubs in a fan-like serial manner.

12. A golf bag according to claim 11 wherein the series of golf club retaining means comprises a central series of golf club retaining means which are rigidly held by said generally tubular bag member in a generally curved arrangement in some of said locations around the inner circumference of the sidewall, and comprises a first outer series and a second outer series of golf club retaining means arranged in locations around the inner circumference of the sidewall on either side of said central series of golf club retaining means and adjacent the respective rigid edge members, said first and second outer series of golf club retaining means being free to fan out when the bag is opened.

13. A golf bag according to claim 11 wherein the opening means is a lever having a free end and an end which is pivotally attached to a bag member; the free end being movable downwardly between said opposed edge members from an upper position wherein the bag is closed to a lower position wherein the bag is opened.

14. A golf bag according to claim 11, which further comprises locking means for locking the opening means in a position wherein the bag is open or closed.

15. A golf bag according to claim 11, wherein the opening means comprises spring means which resiliently biases the bag into the open position wherein the clubs are presented in a fan-like serial manner; and which further comprises closing means operating against the spring means to close the bag.

* * * * *